United States Patent [19]

La Ferla et al.

[11] 4,082,283

[45] Apr. 4, 1978

[54] THREE-DIMENSIONAL BOARD GAME

[76] Inventors: Vivian R. La Ferla, 268 Fruit Hill Ave., N. Providence, R.I. 02910; Janine E. Moreau, 14 Apple Blossom La., Coventry, R.I. 02816; Mariano Rodrigues, 100 Friendly Rd., Cranston, R.I. 02911

[21] Appl. No.: 721,178

[22] Filed: Sep. 7, 1976

[51] Int. Cl.[2] ..... A63F 3/00

[52] U.S. Cl. ..... 273/241; 273/153 J

[58] Field of Search ..... 273/130, 131, 133

[56] References Cited

U.S. PATENT DOCUMENTS

| | | | |
|---|---|---|---|
| 2,313,473 | 3/1943 | Heacock et al. | 273/130 AC |
| 3,656,755 | 4/1972 | Thompson | 273/131 AC |
| 3,658,334 | 4/1972 | Burden | 273/133 |
| 3,767,201 | 10/1973 | Harper et al. | 273/131 AC |
| 3,884,474 | 5/1975 | Harper | 273/130 AC |

*Primary Examiner*—Richard C. Pinkham
*Attorney, Agent, or Firm*—Salter & Michaelson

[57] ABSTRACT

This invention relates to a three-dimensional game and to a multilevel game board structure for use therewith. The game board includes a plurality of plate-like members that are disposed in generally parallel, vertically spaced relation, the plate members decreasing in size in ascending order and having a plurality of playing positions arranged thereon on which game pieces are located. Play of the game may be either solitaire or in opponent fashion and is accomplished by jumping a game piece over an adjacent game piece to an unoccupied playing position. Movement of the game pieces occurs in a horizontal direction on each plate member or in a three-dimensional direction following planes that pass through various playing positions in vertically adjacent plates.

9 Claims, 6 Drawing Figures

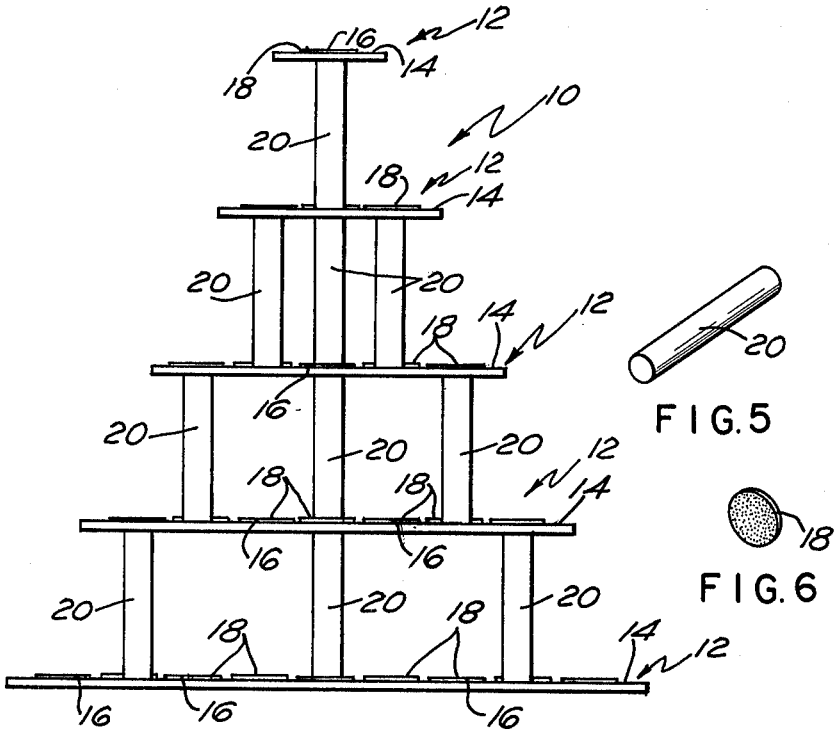
FIG. 5
FIG. 6
FIG. 3
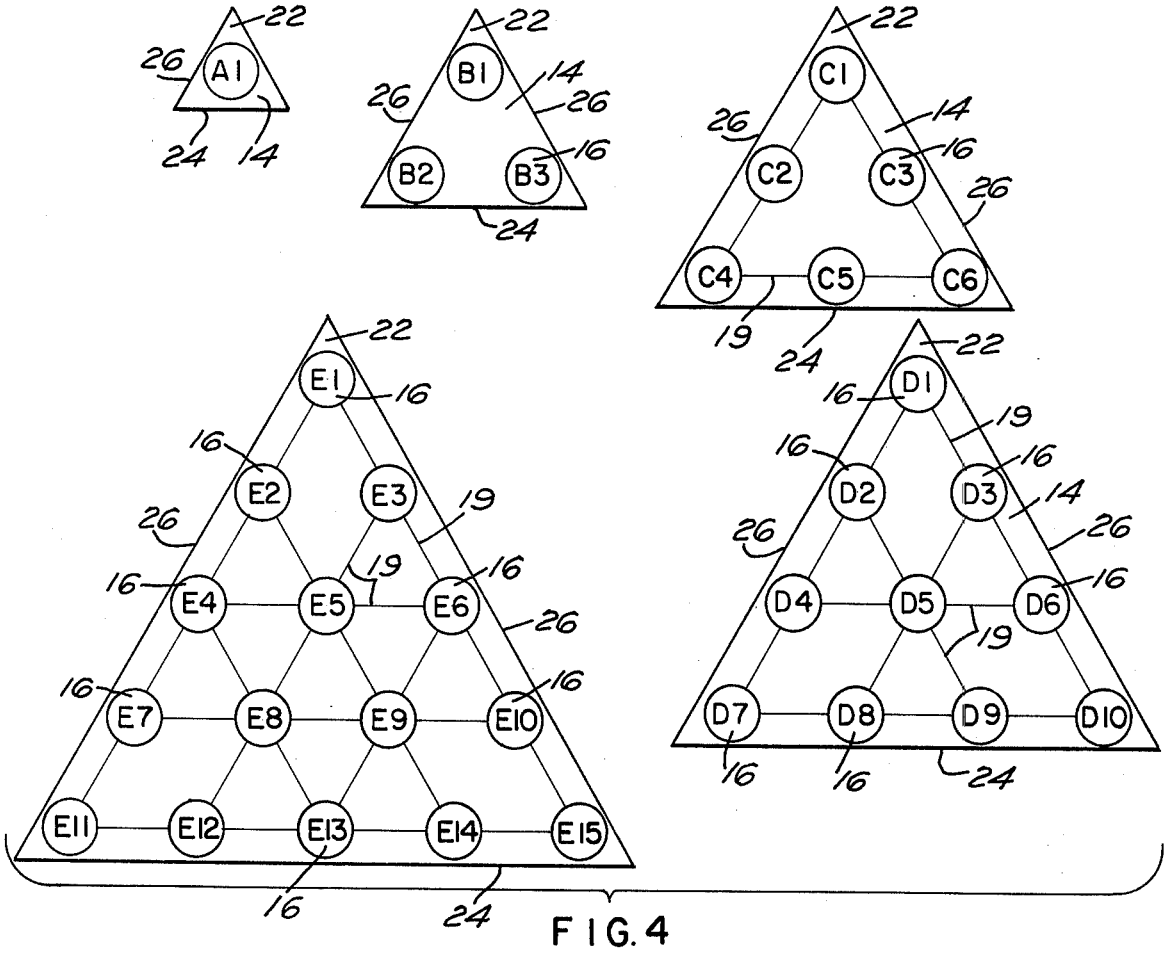
FIG. 4

THREE-DIMENSIONAL BOARD GAME

BACKGROUND OF THE INVENTION

This invention relates to a game apparatus and more particularly to a novel multilevel game board adapted for use in three-dimensional jumping games. Three-dimensional game boards, including those of multilevel structure, are known and include those utilized for two-dimensional chess, checkers and tic-tac-toe. Such game apparatus are disclosed for example in U.S. Pat. Nos. 3,399,895; 3,656,755; 3,767,201 and 3,884,474.

The games as described in these prior patents often require opponent participation, that is, they cannot be played solitaire and, furthermore, in some instances, simultaneously carry on different games at the plurality of levels provided, unlike the game of the subject invention, where a single game is carried on at all levels.

SUMMARY OF THE INVENTION

The present invention defines an interesting and challenging game by use of a multilevel game board on which game pieces are moved in either a horizontal or three-dimensional direction. At least three horizontal plate members are provided that are disposed in generally parallel, equally spaced, vertically disposed relation to each other, each plate member having in descending order a greater number of playing positions located thereon and, accordingly, forming a plurality of triangularly-shaped playing surfaces each having an apex, a base edge opposite thereto and intermediate connecting side edges. The edges of the playing surfaces on successive plates each define a generally vertically disposed playing surface in addition to the horizontally disposed playing surfaces. Moves are accomplished by jumping a game piece over an adjacent game piece to an unoccupied playing position and thereafter removing the jumped game piece from the game board. Such moves may be accomplished in the several playing surfaces provided as long as they are moved in any of the straight line sets of at least three playing positions provided by the several playing surfaces.

It is therefore a primary object of the instant invention to provide a multilevel game board on which novel and interesting jumping games may be played either solitaire or against an opponent.

Another object of the present invention is the provision of a multilevel game board of the aboveindicated nature, wherein playing surfaces are provided along several horizontally and vertically disposed planes, and wherein jumping moves are made along lines of at least three playing positions present within such planes.

A further object of the invention is the provision of a multilevel game board that has educational value by enhancing participant recognition of various depth and planar attitudes in the play of the game.

Still another object of the invention is the provision of a multilevel game board for three-dimensional piece jumping games, wherein several horizontally disposed playing surfaces thereof may be conveniently supported in spaced relation to each other by flexible members connecting successive board layers so that the game board may be collapsed while not in use.

A still further object of the present invention is the provision of a multilevel game board, wherein several horizontally spaced board surfaces thereof are provided in the form of equiangular triangles which decrease in size in ascending vertical order so that an overall pyramid appearance is obtained.

Other objects, features and advantages of the invention will become apparent when the description thereof proceeds when considered in connection with the accompanying illustrative drawings.

DESCRIPTION OF THE DRAWINGS

In the drawings which illustrate the best mode presently contemplated for carrying out the present invention:

FIG. 3 is a side elevational view thereof;

FIG. 4 is a top plan view of the several plates or board surfaces comprising the game board in which playing positions of each level thereof have arbitrary indentifying indicia indicated thereon that are used to describe the manner in which the game is played;

FIG. 5 is a perspective view of one of the column supports used to space the several plates one from the other; and FIG. 6 is a perspective view of one form of a disc-like game piece that is utilized in the play of the game.

DESCRIPTION OF THE INVENTION

Figure 1:
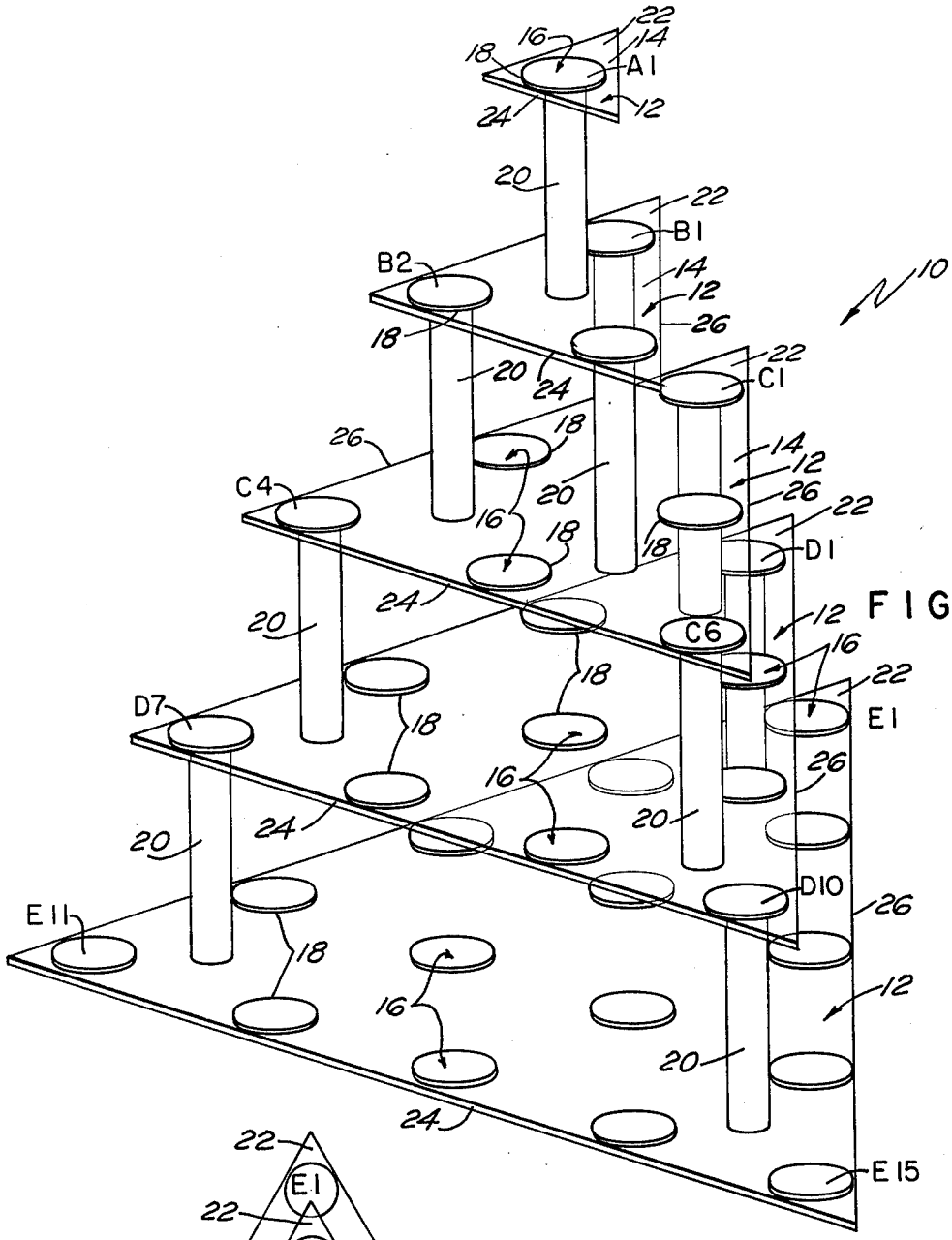
FIG. 1 is an overall perspective view of the multilevel game board apparatus embodied in the present invention.
Figure 2:
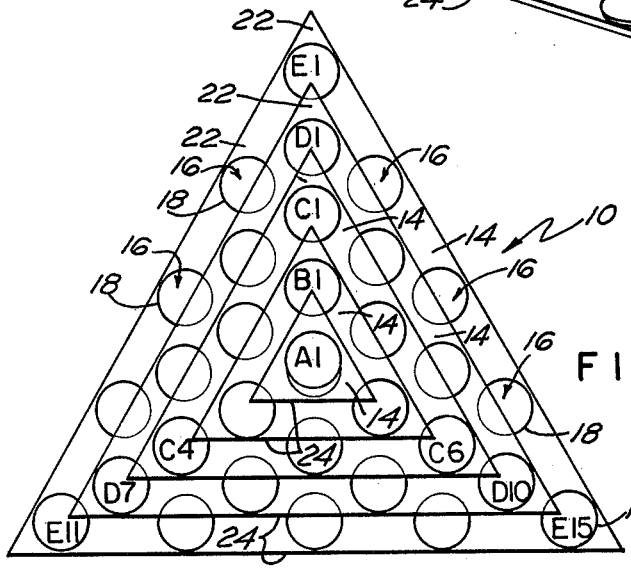
FIG. 2 is a top plan view thereof.

Referring now to the drawings and more particularly to FIG. 1, the multilevel game board of the present invention is illustrated and is generally indicated at 10. As shown, the game board 10 includes five board surfaces or plates 12 on each of which a playing surface 14 is defined. Each playing surface 14 also includes a plurality of playing positions 16. The plates 12 are preferably formed of a rigid, generally transparent, plastic material such as polystyrene or an acrylic resin so that in the play of the game the players can view the several playing surfaces 14. As illustrated in FIG. 1, each plate 12 accommodates a plurality of game pieces 18 that are initially located on various playing positions 16, the playing positions 16 defining the direction of the various jumping moves that are made in accordance with the rules of the game as will be described hereinafter. Each plate 12 is also vertically spaced from an adjacent plate 12 in generally parallel relation by a plurality of rigid spacer elements 20 that have flat terminal surfaces and that can be affixed to each plate 12 by adhesive or other conventional means of attachment.

Each successive playing surface 14 of a plate 12 preferably defines an equilateral triangle having an epex 22, a base edge 24 and interconnecting side edges 26, the plates 12 decreasing in size in ascending order to provide for a different number of playing positions 16 thereon. It is also seen that the configuration of each plate 12 preferably but not necessarily forms the triangular shape of each playing surface 14, that is, a plate 12 could be of a square, circular or rectangular configuration in which the triangular playing surface 14 would be defined by means of the positioning of the playing positions 16 thereon.

The number and relationship of various playing positions provided within the several playing surfaces 14 is best explained by reference to FIG. 4, wherein the largest and lowermost disposed playing surface designated as level E contains an apex 22 having a singular playing position E1 and a base edge 24 having five playing positions E11–E15. Intermediate the base edge 24 and apex 22, other parallel rows of playing positions are arranged. Thus, on a playing surface such as level E, which has a base edge containing five playing positions, five parallel rows of playing positions are provided. Each upwardly ascending plate contains one less playing position for each row. Thus, plate E contains five parallel rows of playing positions, for example, E1-1-E15, E7-E10, E4-E6, E2-E3 and E1. Similarly parallel rows on plate E are readable from either side edge 26 toward the opposite apex. Similarly, the playing surface designated level D and positioned above level E contains one less playing position along its base edge than that of level E and includes one less parallel row of playing positions; that is, the four-three-two-one relationship shown. Each successive playing surface contains one less playing position along its base edge until, as shown by Level A, only one playing position exists. Furthermore, each successively higher playing surface 14 is dimensioned in the same proportion of the remaining playing surfaces so that a playing surface having fewer rows of playing positions is of a smaller overall dimension so that an overall appearance of the game board produces a pyramid configuration.

While the game board illustrated shows the respective use of descending playing surfaces having 1, 3, 6, 10 and 15 playing positions provided respectively therein, such particular relationship is not strictly required so long as the relationship above explained is provided. Thus, each of the other higher levels has successively one less playing position along the base edge thereof, the parallel ascending row configuration of each playing surface thereby being maintained. It is also seen that the upper terminal playing surface of an operable game board could be maintained at the C level and the base level could be either at the E level to provide the necessary three-layered play structure, or succeeding F and G levels could thereafter be added to accommodate the preferred five level construction. A playing surface 14 is not only provided in the plane of each horizontally disposed plate 12, but is also formed along those planes passing through the respective edges of each successive horizontally disposed playing surface.

The game pieces may comprise any object which can be conveniently placed on the playing positions 16 which are, in turn, formed in any fashion, either permanently with material such as painted circles or dots, or with an indentation or opening, or semipermanently with removable pressure sensitive stickers or the like. The game pieces as illustrated include a disc-like chip 18 depicted in FIG. 6. Marbles or other arcuate objects for receipt in depressions or openings provided in the horizontally disposed plates as well as other movable game elements may similarly be used.

The objects of the invention are accomplished by the movement of the game pieces 18 in the manner of jumps wherein one piece may jump over an adjacent piece and land on an unoccupied playing position 16. Thus, for a jump or move to be accomplished, three playing positions 16 must be located in aligned relation either horizontally on a plate 12 or three-dimensionally along the edges of the various levels or interiorly thereof. Such in-line positioning may occur in any of the playing surface planes above-discussed and may be additionally defined by the use of line markings 19 connecting each of the groups of three or more playing positions 16 on a plate and along which permissible moves may be taken. The markings 19 may be either permanent or temporary and may be marked on the plates 12 by the same previously disussed means utilized to delineate the playing positions 16. A jump can be performed in the plane of any of the three bottommost levels herein depicted, or along any edge formed by the respective corners of the playing levels, or along any of the aligned playing positions as located in the vertically spaced plates. Examples of the various types of moves that may be accomplished are as follows:

EXAMPLE 1

Positions C4, C5 occupied, C6 unoccupied. C4 jumps to C6; the playing piece 18 on C5 is removed from the game board. This is a move on the C level.

EXAMPLE 2

Positions A1, B2 occupied, C4 unoccupied, A1 jumps to C4; the playing piece 18 on B2 is removed from the game board pyramid. This is a move along an edge.

EXAMPLE 3

Positions B2, D5 occupied, D9 unoccupied. B2 jumps to D9; the playing piece 18 on C5 is removed from the pyramid. This is a move in an upright plane along a face of the pyramid.

EXAMPLE 4

Positions C2, D5 occupied, E9 unoccupied. C2 jumps to E9; the playing piece 18 on D5 is removed from the pyramid. This move is in an upright plane parallel to a plane passing through a face of the pyramid.

Each move or jump accomplishes the removal of the jumped playing piece 18 with the general object of the various modes of operation of the game being to either remove as many of a selected number of pieces 18 as possible, or to accomplish the arrangement of those remaining pieces in such a manner that permissible moves of an opponent are blocked. Thus, when played as solitaire each playing position 16 except one is covered by a playing piece 18 and the object of the game is to remove all but one piece from the several playing surfaces. A variation of this game mode can be accomplished by providing for different starting positions, that is, varying the single unoccupied playing position 16 on various playing levels and positions therein. When played with an opponent, all playing positions 16 except one are occupied with a game piece 18; thereafter each player takes alternate moves, the winner being determined by the last person able to make a permissible move. A variation of opponent play is to vary the unoccupied playing position 16 as in solitaire play and to allow for multiple jumps. Another variation of opponent play is to win by forcing the opponent to make the last move. Also, in either play mode and particularly in opponent type, several playing positions can be unoccupied at the start of play to initially increase the number of moves and accordingly the initial complexity of the game.

The positioning of the horizontally disposed playing surfaces one above the other has been achieved in the above description by the use of the rigid separator members 20 mounted proximal to the corner of each horizontally disposed triangular playing surface 14 and inwardly of the playing position 16 positioned at each such corner. It is possible, and in some cases preferable, to achieve such separation by means of nonrigid, i.e., flexible members. Such flexible members may take the form of strings or cords similarly positioned as the rigid members 20, and affixed at either end thereof to the plates 12 as by suspension through openings provided therein or as otherwise affixed thereto. In such cases the entire structure would be suspended, i.e., from its topmost plate rather than supported from its lowermost plate, as through the use of a hook or ties by a suspending string. This construction would permit easy collapsing and storing of the game.

It is accordingly believed that a novel game having a high strategy value and interest, both from educational and entertainment standpoints, has been accomplished and that such is achieved by the use of the novel game board structure herein disclosed.

While there is shown and described herein certain specific structure embodying the invention, it will be manifest to those skilled in the art that various modifications of the parts may be made without departing from the spirit and scope of the underlying inventive concept and that the same is not limited to the particular forms herein shown and described except insofar as indicated by the scope of the appended claims.

What is claimed is:

1. A multilevel game board for three-dimensional piece jumping games comprising, a plurality of at least three plates disposed in generally parallel, vertically spaced relationship to each other, each said plate having at least one playing position delineated thereon and forming a generally equiangle triangular, horizontally disposed playing surface having an apex, a base edge opposite thereto and intermediate connecting side edges, the number of playing positions provided on each such successive playing surface progressively decreasing in ascending order in accordance with the number of parallel rows of playing positions extending from the base edge to the apex provided thereon, the respective base and intermediate edges of said successive playing surfaces forming respective edge planes in turn defining at least three generally vertically disposed playing surfaces which further intersect in a pyramidal form and wherein a plurality of straight line jump paths of at least three playing positions are formed along the lines connecting the corners of each successive horizontally disposed playing surface, along lines within each of said generally vertically disposed playing surfaces and along lines within at least one of said horizontally disposed playing surfaces.

2. A multilevel game board for three-dimensional games in which a plurality of individually movable game pieces are utilized, comprising at least three game plates disposed in parallel, vertically spaced, coaxial relation, each of said plates defining a horizontally disposed playing surface having a base edge and intermediate connecting side edges that define an equilateral triangle, and each plate having at least one playing position located thereon, wherein a playing position is defined by a specific location on a plate to which a game piece is movable, each of said plates having a predetermined number of parallel rows of playing positions located thereon, the number of parallel rows on each plate corresponding to the number of playing positions located adjacent to the base or side edges thereof, and the number of playing positions in each row of a plate progressively decreasing in descending order from the base edge or a side edge to the opposite junction of the remaining edges thereof, the number of playing positions located on each playing surface progressively decreasing in ascending order, wherein the number of playing positions adjacent to a base or side edge of each plate is greater than the number of corresponding playing positions located on a playing surface that is disposed vertically thereabove, the respective base and intermediate side edges of said successive playing surfaces forming respective edge planes that define a plurality of generally vertically disposed playing surfaces, wherein a plurality of straight line jump paths are formed along the lines connecting the corners of each successive horizontally disposed playing surface, along the lines within each of said generally vertically disposed playing surfaces and along the lines within at least one of said horizontally disposed playing surfaces.

3. The game board structure of claim 2, wherein the largest of such plates is located at the lowermost position of said game board.

4. The game board structure of claim 2, wherein each of said plates is formed of substantially transparent material.

5. The game board structure of claim 4, wherein each playing position as located on a playing surface is defined by a generally opaque dot adapted for receipt of a playing disc thereon.

6. The game board structure of claim 4, wherein each plate is spaced from each other plate successively thereabove by equal length, rigid supports, each support positioned proximal to each corner thereof, wherein said supports form at least three upwardly ascending progressively inwardly extending rows thereof, each of said supports further inwardly spaced from its respective corner disposed playing position.

7. The game board structure of claim 4, wherein there are included secondary playing surfaces in planes parallel and inwardly disposed to said generally vertically disposed playing surfaces.

8. The game board structure of claim 7, wherein there are five horizontally disposed playing surfaces provided and wherein the number of rows of playing positions in each such successively lower playing surface increases by one.

9. The game board structure of claim 8, there being five rows on the lowest playing surface and respectively 15, 10, 6, 3 and 1 playing positions on the upwardly ascending playing surfaces.

* * * * *